US007953243B2

(12) United States Patent
Liusvaara

(10) Patent No.: US 7,953,243 B2
(45) Date of Patent: May 31, 2011

(54) GASKET AND ASSOCIATED APPARATUS AND METHODS

(75) Inventor: Tapio Liusvaara, Tampere (FI)

(73) Assignee: Nokia Corporation, Espoo (FI)

( * ) Notice: Subject to any disclaimer, the term of this patent is extended or adjusted under 35 U.S.C. 154(b) by 1307 days.

(21) Appl. No.: 11/486,829

(22) Filed: Jul. 14, 2006

(65) Prior Publication Data

US 2008/0013782 A1 Jan. 17, 2008

(51) Int. Cl.
*H04R 1/02* (2006.01)

(52) U.S. Cl. ..... 381/392; 381/393; 381/395

(58) Field of Classification Search ..... 381/392, 381/393, 395
See application file for complete search history.

(56) References Cited

U.S. PATENT DOCUMENTS 6,744,900 B1 * 6/2004 Turner et al. ..... 381/355
2005/0190942 A1 * 9/2005 Moquin et al. ..... 381/355

* cited by examiner

*Primary Examiner* — Brian Ensey
(74) *Attorney, Agent, or Firm* — Harrington & Smith

(57) ABSTRACT

The invention relates to a gasket, and in particular a gasket for acoustically sealing an audio component inside an electronic apparatus. A gasket for acoustically sealing an audio component inside an electronic apparatus, the gasket including a plurality of elongate channels extending through the gasket, the gasket being configured to provide a lower acoustic resistance through the channels than transverse to the channels.

22 Claims, 4 Drawing Sheets

GASKET AND ASSOCIATED APPARATUS AND METHODS

The invention relates to a gasket, and in particular a gasket for acoustically sealing one or more audio components inside an electronic apparatus. Associated apparatus and methods are also within the scope of the invention.

BACKGROUND

Audio components have to be acoustically sealed inside an electronic apparatus in order to achieve optimal performance and to avoid audio components disturbing each other acoustically inside the same apparatus.

A known acoustical sealing gasket comprises a single aperture corresponding in size to an aperture in the casing of the electronic apparatus in which it is incorporated. The gasket is arranged to provide for sonic communication between an audio component and the aperture in the casing, and to acoustically seal the audio component from other components within the electronic apparatus. A separate dust cloth is required with such a gasket in order to protect the audio component from dust and other foreign particles.

The various parts of the electronic apparatus have to be assembled such that the apertures in the casing and gasket are co-axial with that of the audio component. Such alignment causes problems owing to mechanical tolerances and the continuing reduction in size of consumer electronic apparatus and audio components. It is known to solve these problems by careful design to take into account manufacturing and assembly tolerances, and tolerance-chain calculations.

SUMMARY

According to a first aspect of the invention, there is provided a gasket for acoustically sealing an audio component inside an electronic apparatus, the gasket comprising a plurality of channels extending through the gasket, the gasket being configured to provide a lower acoustic resistance through the channels than transverse to the channels.

By providing multiple (and consequently smaller) channels instead of a large, single aperture, the gasket of the present invention obviates the need to align an aperture in the gasket with apertures in the casing and audio component, thereby alleviating the problems regarding mechanical tolerances described above.

Each channel may be dimensioned to inhibit the passage of dust through the channel. In this way, the gasket serves both as a gasket and a dust cloth, eliminating the need for a separate gasket and dust cloth as in the prior art.

Gasket channel openings may be dimensioned to have apertures which are smaller than a sonic aperture in the audio component.

Gasket channel openings may be dimensioned to have apertures which are smaller than a sonic aperture in the electronic apparatus.

The gasket may comprise a honeycomb arrangement of adjacent elongate channels. The (elongate) channels may be substantially parallel, and/or may extend rectilinearly through the gasket.

The gasket may be formed of a compressible material and/or an elastomer material.

The audio component may be mounted on a printed wiring board (PWB). Mounting may be by, for example, soldering to provide permanent electronic contact, or by some mounting method to provide non-permanent contact between the PWB and the electronic component.

According to a second aspect of the invention, there is provided an electronic apparatus comprising a casing having an aperture region with an aperture;

an audio component arranged to be in sonic communication with the aperture; and a gasket interposed between the audio component and the aperture region of the casing and arranged such that its channels extend in a desired direction of said sonic communication.

The apparatus may be configured such that the gasket is under compression between the audio component and the aperture region.

The apparatus may be an electronic device or an electronic device module.

According to a third aspect of the invention, there is provided a module for an electronic apparatus, the module comprising an audio component arrangeable to be in sonic communication with an aperture of a casing of the electronic apparatus; and a gasket according to claim 1 arrangeable to be interposed between the audio component and an aperture region of the casing having the aperture and arrangeable such that its channels extend in a desired direction of said sonic communication.

According to a fourth aspect of the invention, there is provided means for acoustically sealing an audio component inside an electronic apparatus, the means comprising a plurality of elongate channels extending there through and being configured to provide a lower acoustic resistance through the channels than transverse to the channels.

According to a fifth aspect of the invention, there is provided a method of assembling an electronic apparatus, the method comprising interposing the gasket of claim 1 between an audio component and an aperture region of the casing having an aperture; and arranging the gasket such that its channels extend in a desired direction of sonic communication between the audio component and the aperture.

The method may comprise compressing the gasket between the audio component and the aperture region.

The present invention includes one or more aspects, embodiments and/or features of said aspects and/or embodiments in isolation and/or in various combinations whether or not specifically stated (including claimed) in that combination or in isolation.

BRIEF DESCRIPTION OF THE DRAWINGS

In order that the invention may more readily be understood, a description is now given of specific embodiments, by way of example only, reference being made to the accompanying drawings, in which:-

DETAILED DESCRIPTION OF SPECIFIC EMBODIMENT OF THE INVENTION

Figure 1:
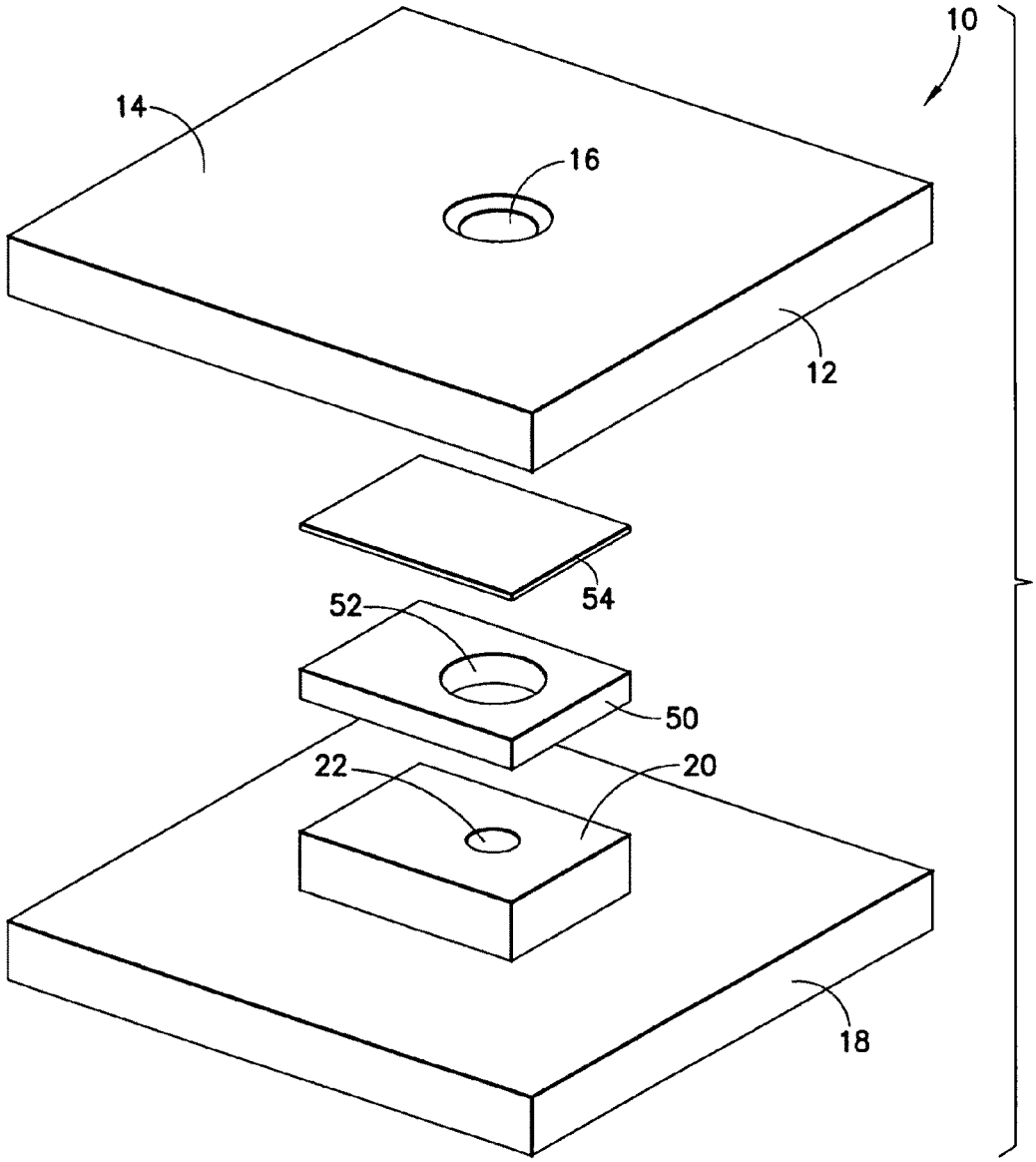
PRIOR ART FIG. 1
FIG. 1 is an exploded view of an electronic apparatus having a prior art gasket arrangement.

FIG. 1 shows an electronic apparatus 10 having a prior art gasket arrangement.

The electronic apparatus 10 includes an exterior casing 12 having an aperture region 14 with an aperture 16, and also includes a printed wiring board (PWB) 18 on which an audio component 20 is mounted. The audio component 20 transmits and/or receives sound through an aperture 22 in the audio component 20. The audio component 20 may provide microphone and/or speaker functionality.

In order to acoustically seal the audio component 20 within the electronic apparatus 10, a gasket 50 is provided having an aperture 52.

During assembly of the electronic apparatus 10, the respective apertures 16, 52 and 22 of the casing 12, gasket 50 and audio component 20 must be aligned within a certain manufacturing tolerance, such that the audio component 20 is in optimum sonic communication with the aperture 16 in the casing 12. The gasket aperture 52 is larger than both the casing aperture 16 and audio component aperture 22. A dust cloth 54 protects the audio component 20 from the ingress of dust through the respective apertures of the gasket 50 and audio component 20.

Figure 2:
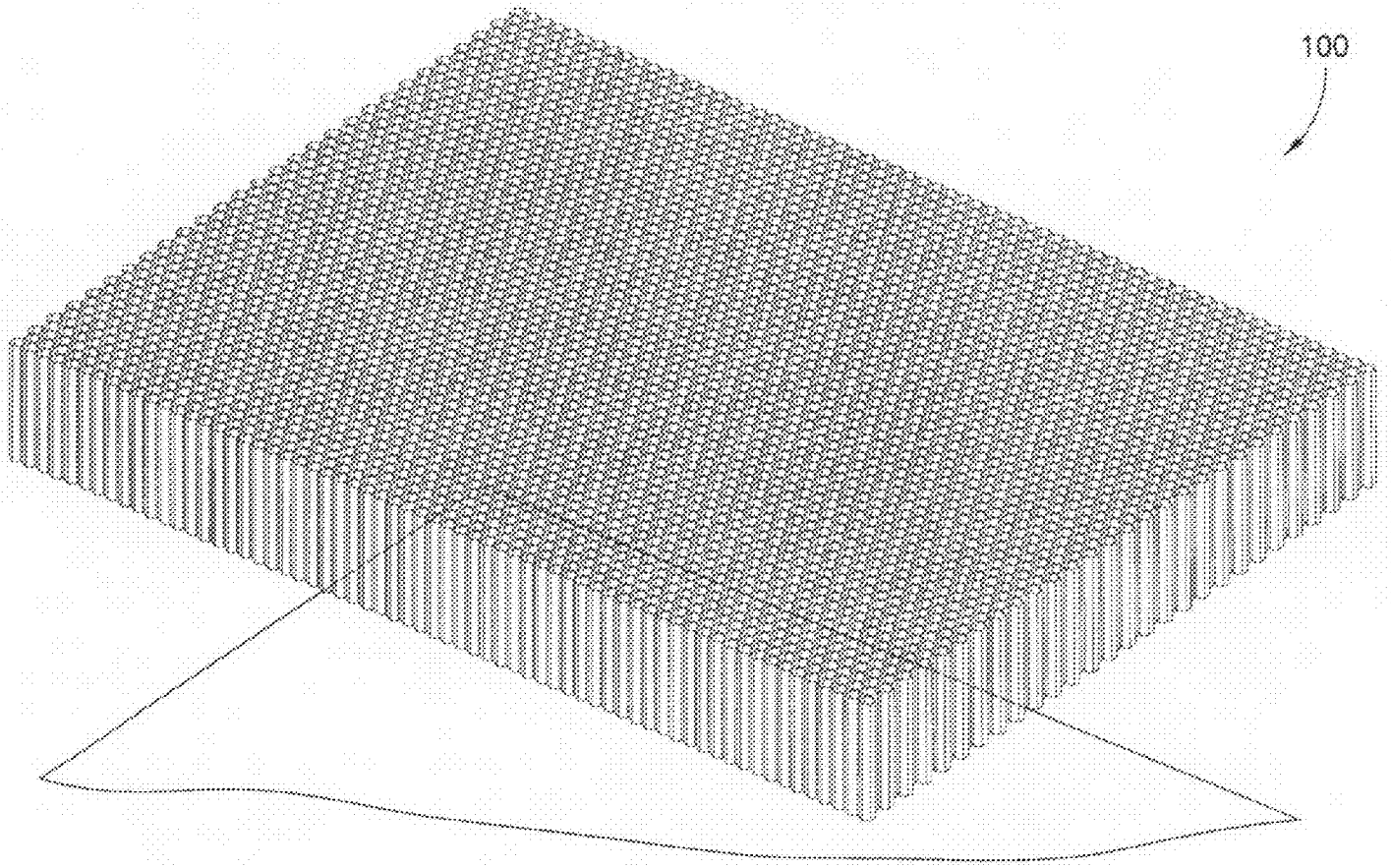
FIG. 2 shows a gasket according to the invention.

FIG. 2 shows a gasket 100 according to the invention. The gasket 100 may be used in place of the prior art gasket 50 as shown in FIG. 1, and also replaces the dust cloth 54.

Figure 3:
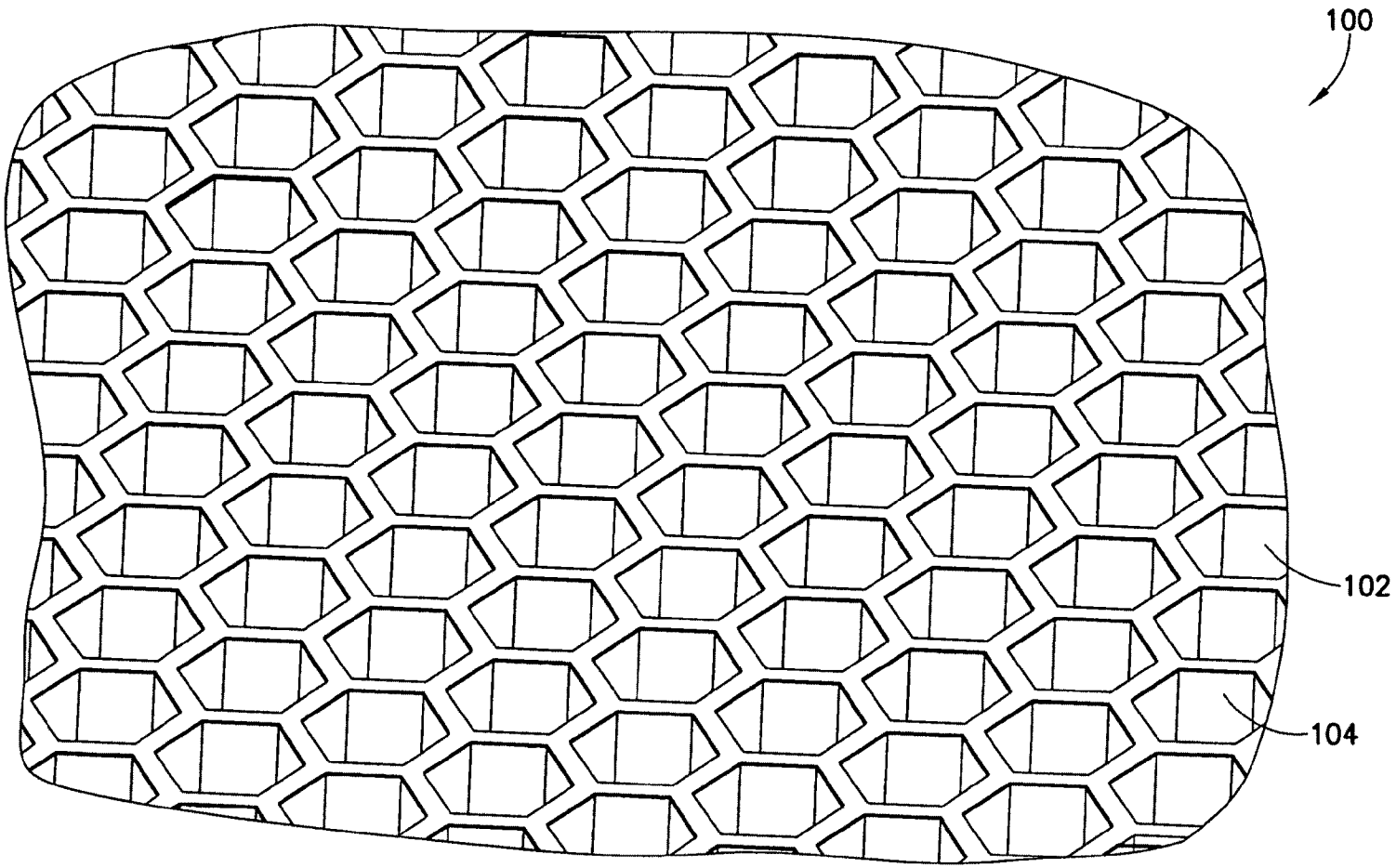
FIG. 3 shows the gasket of FIG. 2 in more detail.

FIG. 3 shows the gasket 100 in more detail.

The gasket 100 includes a plurality of elongate channels 102 extending through the gasket 100. In this way, the gasket 100 provides a lower acoustic resistance through the channels 102 than transverse to the channels 102. In this embodiment, adjacent channels 102 are formed in a honeycomb arrangement, although it is to be understood that this an example and that any arrangement of adjacent channels would be appropriate. For example, the channels 102 may be arranged in rows and columns instead of the staggered arrangement of the honeycomb, although it will be appreciated that the honeycomb arrangement provides a higher density of channels 102. Moreover, while the honeycomb arrangement implies a certain geometric shape of the channel opening 104 (as seen in FIG. 3), it will be understood that any geometric shape of channel opening 104 would be suitable. For example, a circular or pentagonal cross-section could be used. In practice, the skilled person will favour the arrangement of channels 102 and/or the shape of channel opening 104 which provides for the simplest/cheapest manufacture of the gasket 100.

When the gasket 100 is uncompressed, the channels 102 extend in a parallel, rectilinear fashion through the gasket 100. The gasket is formed of a compressible elastomer material.

The channels 102 are smaller than the audio component aperture 22 and the casing aperture 16.

Each channel 102 is dimensioned to inhibit the passage of dust through the channel 102. In this embodiment, in order to provide an optimum dust-inhibiting effect whilst still providing for sonic communication, the diameter of each channel opening 104 is preferably in the range of about 0.05 mm to about 0.2 mm, and more preferably about 0.1 mm. The density of channels 102 is preferably in the range of about 20 per $cm^2$ to about 200 per $cm^2$ (when viewing the top surface of the gasket 100 as shown in FIG. 3). The depth of the channels 102 is preferably in the range of about 0.2 mm to about 1.0 mm. The thickness of the channel walls is preferably in the range of about 0.01 mm to about 0.1 mm. The density of the elastomer material has a Shore value (A) (the compression hardness for the rubber material of an acoustical sealing material) which is preferably in the range of about 40° to about 70°. The density of the material is preferably in the range of about 0.9 $g/cm^3$ to about 1.5 $g/cm^3$.

Figure 4:
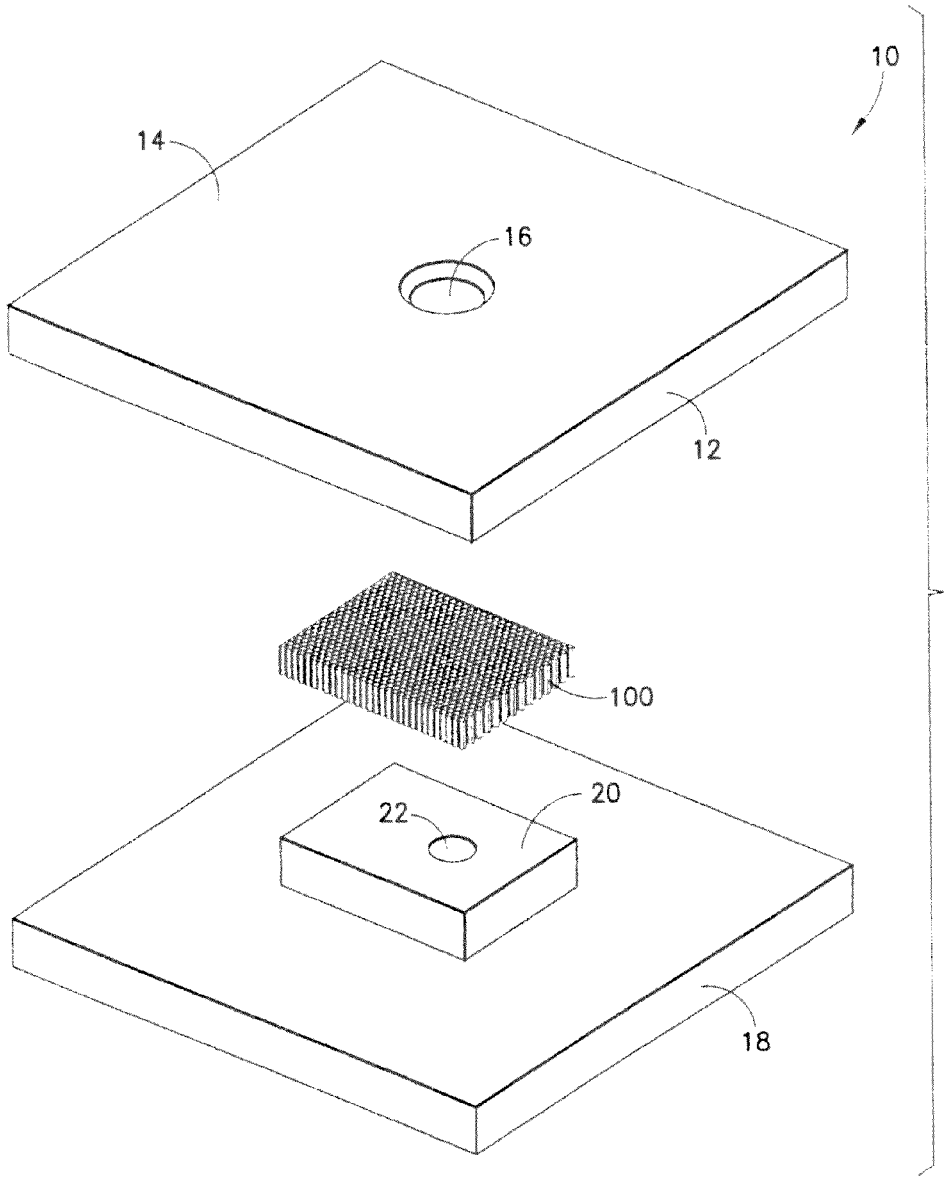
FIG. 4 is an exploded view of an electronic apparatus having the gasket of FIG. 2.

FIG. 4 shows the electronic apparatus 10 having the gasket 100. In this example, the electronic apparatus 10 is a hand-portable electronic device (e.g. a radiotelephone). In other embodiments, the apparatus may not comprise radiotelephone functionality. The apparatus may be an audio player/recorder (e.g. MP3 or other format music player) and may not be user hand-portable. The apparatus may be hand-held in use.

As seen, the gasket 100 is interposed between the audio component 20 and the aperture region 14 of the casing 12, and is under compression between the audio component 20 and the aperture region 14. The gasket 100 is arranged such that its channels 102 extend between the aperture 22 of the audio component 20 and the aperture 16 of the casing 12, so as to provide for sonic communication between those two apertures, and to acoustically seal the audio component 20 from other components within the apparatus 10. It will be understood that, although the gasket 100 is compressed (in this case elastically compressed), its channels 102 still extend between the audio component 20 and the aperture 16 in the casing 12. The compression may result in the porosity of the material from which the gasket 100 is made being decreased, thereby improving the acoustical sealing. Since the gasket 100 can be positioned anywhere so long as it covers both the apertures 22 and 16, the problems of mechanical tolerance found with the prior art gasket 50 are obviated.

The gasket 100 may be made from a material which has little or no porosity to air and/or water. The gasket 100 may be considered to be made from an air/water tight material. The gasket 100 may not have any channels in any direction other than in the direction of sonic communication (aligned to be substantially parallel to the axis of the aperture 16 of the casing 12 and aperture 22 of the audio component 20). The gasket 100 may be fixed (e.g. adhered) to (e.g. the upper/side) face(s) of the audio component 20 and or the PWB 18. The gasket 100 may be made from a material which is sufficiently rigid to obviate the need for any stretching in order to hold the gasket 100 in place.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features.

In view of the foregoing description it will be evident to a person skilled in the art that various modifications may be made within the scope of the invention. Although the embodiments shown relate to a single audio component (sonic) aperture 22 and a single exterior casing (sonic) aperture 16, it will be appreciated that the present invention can also be applied to a plurality of adjacent sonic component/casing apertures.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

The invention claimed is:

1. A gasket for acoustically sealing an audio component inside an electronic apparatus, the gasket comprising a plurality of channels extending through a majority of a thickness between opposite sides of the gasket, the gasket being configured to provide a lower acoustic resistance through the channels than transverse to the channels.

2. The gasket of claim 1 wherein each channel is dimensioned to inhibit the passage of dust through the channel.

3. The gasket of claim 1 wherein the gasket is for sealing an audio component which is mounted to a printed wiring board.

4. The gasket of claim 1 wherein gasket channel openings are dimensioned to have apertures which are smaller than a sonic aperture in the audio component.

5. The gasket of claim 1 wherein gasket channel openings are dimensioned to have apertures which are smaller than a sonic aperture in the electronic apparatus.

6. The gasket of claim 1 comprising a honeycomb arrangement of adjacent elongate channels.

7. The gasket of claim 1 comprising substantially parallel elongate channels.

8. The gasket of claim 1 wherein each channel extends rectilinearly through the gasket.

9. The gasket of claim 1 formed of a compressible material.

10. The gasket of claim 1 formed of an elastomer material.

11. An electronic apparatus comprising a casing having an aperture region with an aperture;

an audio component arranged to be in sonic communication with the aperture; and a gasket comprising a plurality of channels extending through a majority of a thickness between opposite sides of the gasket, the gasket being configured to provide a lower acoustic resistance through the channels than transverse to the channels, the gasket arranged to be interposed between the audio component and the aperture region of the casing and arranged such that its channels extend in a desired direction of said sonic communication.

12. The apparatus of claim 11, wherein gasket channel openings are dimensioned to have apertures which are smaller than a sonic aperture in the audio component.

13. The apparatus of claim 11 wherein gasket channel openings are dimensioned to have apertures which are smaller than a sonic aperture in the electronic apparatus.

14. The electronic apparatus of claim 11 configured such that the gasket is under compression between the audio component and the aperture region.

15. The electronic apparatus of claim 11 wherein the apparatus is an electronic device.

16. The electronic apparatus of claim 11 wherein the apparatus is an electronic device module.

17. A module for an electronic apparatus, the module comprising an audio component arrangeable to be in sonic communication with an aperture of a casing of the electronic apparatus; and a gasket comprising a plurality of channels extending through a majority of a thickness between opposite exterior sides of the gasket, the gasket being configured to provide a lower acoustic resistance through the channels than transverse to the channels, the gasket arrangeable to be interposed between the audio component and an aperture region of the casing having the aperture and arrangeable such that its channels extend in a desired direction of said sonic communication.

18. A gasket means for acoustically sealing an audio component inside an electronic apparatus, the gasket means comprising a plurality of channels extending through a majority of a thickness between opposite exterior sides of the gasket and being configured to provide a lower acoustic resistance through the channels than transverse to the channels.

19. A method of assembling an electronic apparatus, the method comprising interposing a gasket between an audio component and an aperture region of the casing having an aperture, the gasket comprising a plurality of channels extending through a majority of a thickness between opposite exterior sides of the gasket, the gasket being configured to provide a lower acoustic resistance through the channels than transverse to the channels; and arranging the gasket such that its channels extend in a desired direction of sonic communication between the audio component and the aperture.

20. The method of claim 19 comprising compressing the gasket between the audio component and the aperture region.

21. The gasket of claim 1 wherein the channels extend entirely through the gasket between opposite sides of the gasket with a substantially uniform cross section between the opposite sides.

22. The apparatus of claim 11, wherein the apparatus does not comprise a separate dust cloth between the gasket and the casing, and wherein the channels are sized sufficiently small to inhibit passage of dust through the channels.

* * * * *